US012680250B2

(12) United States Patent
Kirksey

(10) Patent No.: US 12,680,250 B2
(45) Date of Patent: Jul. 14, 2026

(54) MECHANICAL SAND REMOVAL

(71) Applicant: Kershaw Equipment L.L.C., Chicago, IL (US)

(72) Inventor: William S. Kirksey, Wetumpka, AL (US)

(73) Assignee: Kershaw Equipment L.L.C., Chicago, IL (US)

( * ) Notice: Subject to any disclaimer, the term of this patent is extended or adjusted under 35 U.S.C. 154(b) by 802 days.

(21) Appl. No.: 18/091,403

(22) Filed: Dec. 30, 2022

(65) Prior Publication Data

US 2024/0150983 A1 May 9, 2024

Related U.S. Application Data

(60) Provisional application No. 63/423,045, filed on Nov. 6, 2022.

(51) Int. Cl.
*E01H 8/10* (2006.01)

(52) U.S. Cl.
CPC ..... *E01H 8/10* (2013.01)

(58) Field of Classification Search
CPC ..... E01H 8/00; E01H 8/12; E01H 8/10
USPC ..... 37/207, 206, 203; 104/279; 15/54; 291/1
See application file for complete search history.

(56) References Cited

U.S. PATENT DOCUMENTS 604,543 A * 5/1898 Parmenter et al. ..... E01H 8/10 37/217
605,431 A * 6/1898 Hurst ..... E01H 8/10 37/207
1,081,658 A * 12/1913 Broady ..... A01D 34/52 37/207
1,182,047 A * 5/1916 Stanley ..... B61F 19/02 293/58
1,817,524 A * 8/1931 Protzeller ..... E01B 27/025 37/104
1,993,822 A * 3/1935 Bergstrum ..... B24B 47/06 451/335
3,866,539 A * 2/1975 Gasser ..... B61K 7/18 104/279
6,736,977 B1 * 5/2004 Hall ..... B01J 20/26 588/256
7,273,131 B2 * 9/2007 Urmson, Jr. ..... B61K 3/00 198/500
7,344,145 B2 * 3/2008 Duchet ..... B60G 17/0523 303/6.01

(Continued)

FOREIGN PATENT DOCUMENTS

CN 104594277 A * 5/2015 ..... E01H 8/10
CN 117988174 A * 5/2024 ..... B08B 7/02
EP 2868803 A1 * 5/2015 ..... E01B 19/00

*Primary Examiner* — S. Joseph Morano
*Assistant Examiner* — Maxwell L Meshaka
(74) *Attorney, Agent, or Firm* — Shook, Hardy & Bacon L.L.P.

(57) ABSTRACT

A mechanical sand remover removes sand from a railroad rail and includes an actuator and a pair of web wiper pads having a lateral dimension that corresponds to a lateral dimension of a rail web of the railroad rail. A caliper mechanism is mechanically coupled to the actuator and is operable thereby into a retraction state and an engagement state. The caliper mechanism includes a pair of caliper arms respectively coupled to the web wiper pads at an angle relative thereto.

20 Claims, 9 Drawing Sheets

(56) References Cited

U.S. PATENT DOCUMENTS

| | | | | |
|---|---|---|---|---|
| 9,631,332 | B2 | 4/2017 | Shubs, Jr. et al. | |
| 11,912,320 | B2 * | 2/2024 | Dick | B61L 23/042 |
| 2002/0170207 | A1 * | 11/2002 | Ahmed Baig | E01H 8/10 37/198 |
| 2004/0141853 | A1 * | 7/2004 | Duchet | B60T 17/18 417/282 |
| 2016/0060833 | A1 * | 3/2016 | Shubs, Jr. | E01H 8/10 37/235 |
| 2024/0150983 | A1 * | 5/2024 | Kirksey | E01H 8/10 |

* cited by examiner

MECHANICAL SAND REMOVAL

RELATED APPLICATION DATA

This application claims the benefit of priority under 35 U.S.C. § 119(e) from U.S. Provisional Patent Application No. 63/423,045 entitled "Mechanical Sand Removal," filed Nov. 6, 2022. The disclosure of that provisional patent application is incorporated herein by reference in its entirety.

TECHNICAL FIELD

The present disclosure relates to removal of undesired foreign matter, such as sand, from railroad tracks. More specifically, this disclosure is directed to removing such undesired foreign matter from webs of railroad tracks.

BACKGROUND

Sand plows are deployed in regions of shifting sand where railroad tracks are continually being covered over. A sand plow typically rides on wheels on a railroad track and may include several different mechanisms for sand removal. U.S. Pat. No. 9,631,332 discloses a moveable sand plow for a locomotive that seeks to ameliorate sand build up on railroad tracks. Techniques to clear railroad tracks of sand and other foreign material are actively being sought to produce cleaner rails of railroad tracks.

SUMMARY

A mechanical sand remover removes sand from a railroad rail and includes an actuator and a pair of web wiper pads having a lateral dimension that corresponds to a lateral dimension of a rail web of the railroad rail. A caliper mechanism is mechanically coupled to the actuator and operable thereby into a retraction state and an engagement state. The caliper mechanism includes a pair of caliper arms respectively coupled to the web wiper pads at an angle relative thereto.

In another aspect, a mechanical sand remover system that removes sand from a railroad track includes a pneumatic compressor and a pair of mechanical sand removers that remove sand from the rails. Each of the mechanical sand removers includes an actuator in pneumatic communication with the pneumatic compressor and a pair of web wiper pads having a lateral dimension that corresponds to a lateral dimension of a rail web of the railroad rail. A caliper mechanism is mechanically coupled to the actuator and operable thereby into a retraction state and an engagement state. The caliper mechanism includes a pair of caliper arms respectively coupled to the web wiper pads at an angle relative thereto. A pneumatic control selectively provides pneumatic pressure to the actuator to compel the retraction state and the engagement state of the caliper mechanism.

In yet another aspect, a sand plow that removes sand from a railroad track includes a forward plow blade having a pair of rail voids that accommodate a pair of rails of the railroad track and a pair of mechanical sand removers that remove sand from the rails left by the rail voids in the forward plow blade. Each of the mechanical sand removers includes an actuator and a pair of web wiper pads having a lateral dimension that corresponds to a lateral dimension of a rail web of the corresponding one of the rails. A caliper mechanism is mechanically coupled to the actuator and operable thereby into a retraction state and an engagement state, the caliper mechanism including a pair of caliper arms respectively coupled to the web wiper pads at an angle relative thereto.

DETAILED DESCRIPTION

The word exemplary is used herein to mean, "serving as an example, instance or illustration." Any embodiment of construction, process, design, technique, etc., designated herein as exemplary is not necessarily to be construed as preferred or advantageous over other such embodiments.

In yet another aspect, a sand plow that removes sand from a railroad track comprises a forward plow blade having a pair of rail voids that accommodate a pair of rails of the railroad track and a pair of mechanical sand removers that remove sand from the rails left by the rail voids in the forward plow blade. Each of the mechanical sand removers includes an actuator and a pair of web wiper pads having a lateral dimension that corresponds to a lateral dimension of a rail web of the corresponding one of the rails. A caliper mechanism is mechanically coupled to the actuator and operable thereby into a retraction state and an engagement state and includes a pair of caliper arms respectively coupled to the web wiper pads at an angle relative thereto.

Figure 1:
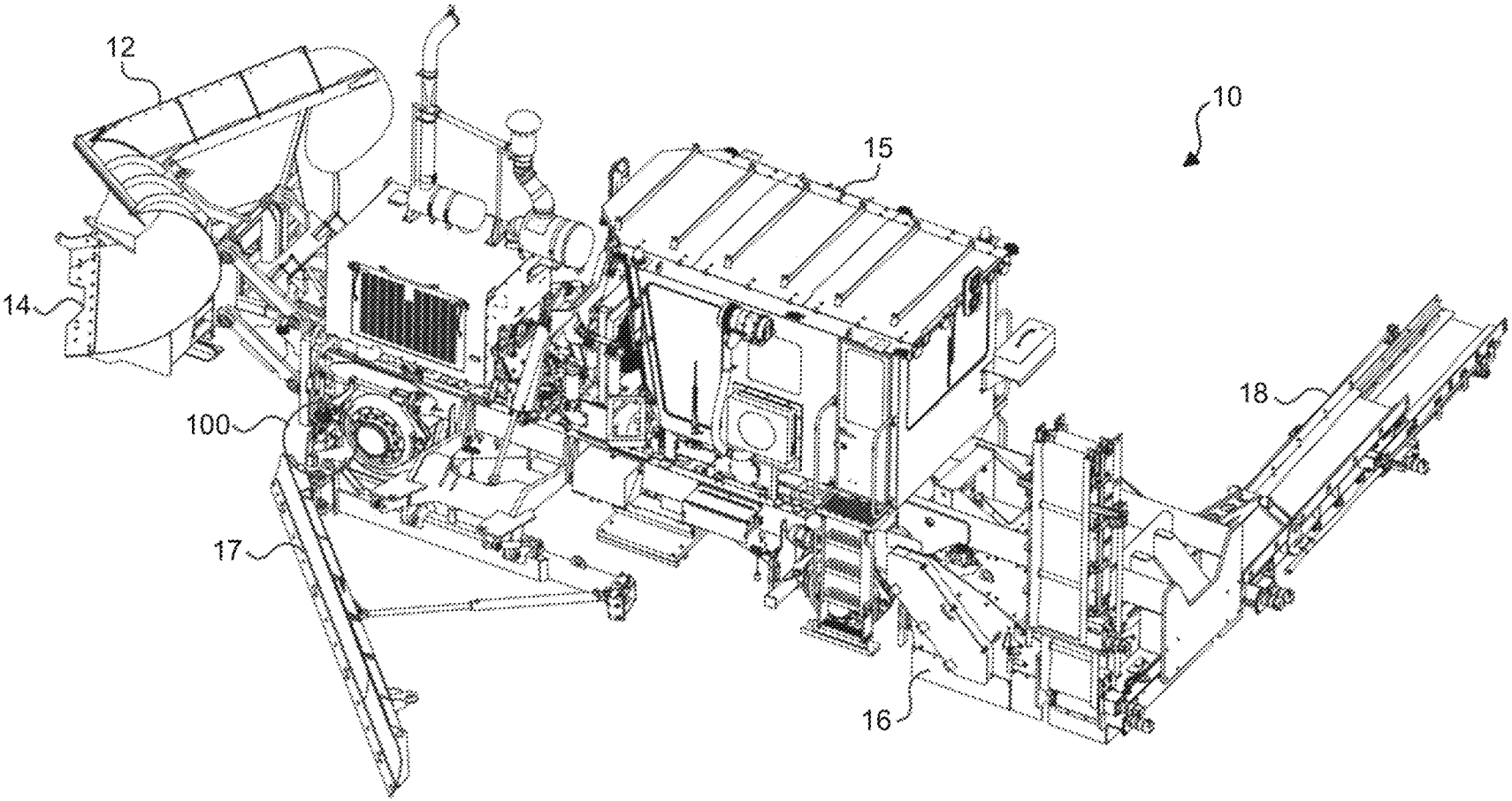
FIG. 1 is an illustration of a sand plow in which the concept described in this disclosure may be embodied.

FIG. 1 is an illustration of a sand plow 10 in which the concept described in this disclosure may be embodied. Sand plow 10 might be deployed in regions of shifting sand where railroad tracks are continually being covered over with sand. Sand plow 10 rides on wheels on a track and may include several different mechanisms for sand removal, for example, a forward plow blade 12 that removes the bulk of the material from the railroad track, one or more outboard plow blades 17 that compels the sand removed by the forward plow blade 12 further away from the tracks and a rotary brush 16 (hidden by housing) that sweeps sand from the tracks and ejects the swept sand on a sand discharge conveyor 18. These and other mechanisms may be selectively deployed, including a mechanical sand remover (MSR) 100 embodying the concept described by the present disclosure, and controlled by a plow operator stationed in operator cabin 15.

Forward plow blade 12 may have a pair of rail voids, representatively illustrated at rail void 14, on its leading edge that accommodates each rail of the railroad track and allows the forward plow blade 12 to be positioned closer to the track bed. This affords deeper penetration into a sand layer deposited on the tracks but leaves an amount of sand around the rails in the shape of rail void 14. Embodiments of the concept described in the present disclosure implement techniques by which that amount of sand is removed including material disposed in the rail web (see FIG. 2). It is to be noted that embodiments may vary, e.g., dimensionally and in materials used, according to the amount of sand left by and forced into the rail web by rail voids 14 whose quantities can be estimated by those with knowledge of mechanics.

The illustrations and descriptions that follow are directed to mechanisms of an embodiment of the concept described in this disclosure around one rail of a pair of rails that comprise a railroad track. It is to be understood that the concept described in this disclosure can be embodied with such a mechanism deployed at both rails and such should be inferred for the examples provided herein.

Figure 2A:
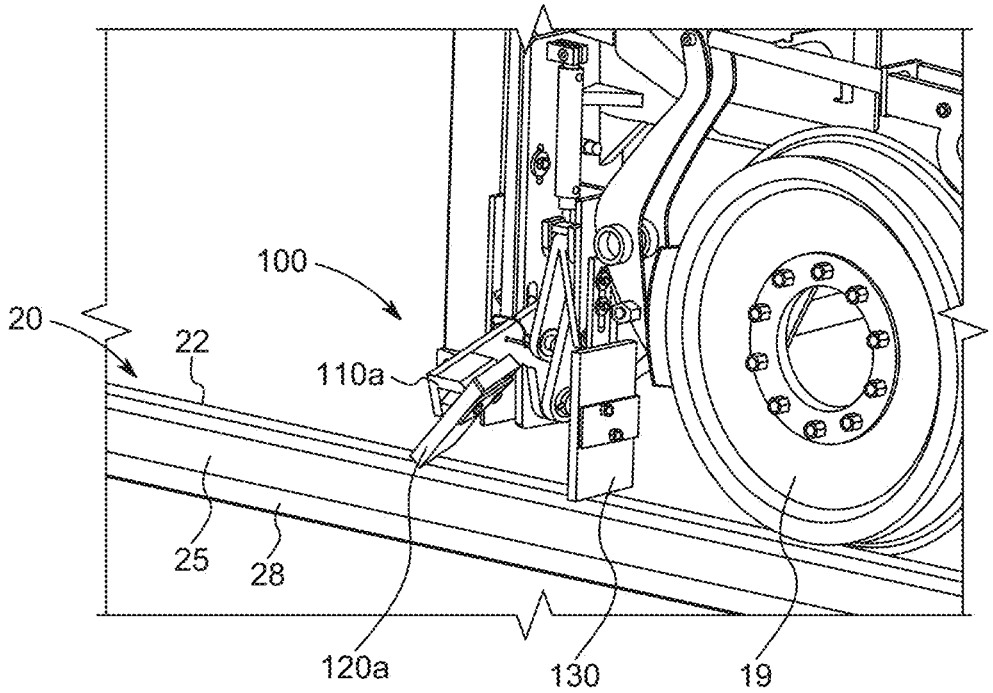
FIGS. 2A-2B are illustrations of a mechanical sand remover by which the concept described in this disclosure may be embodied.
Figure 2B:
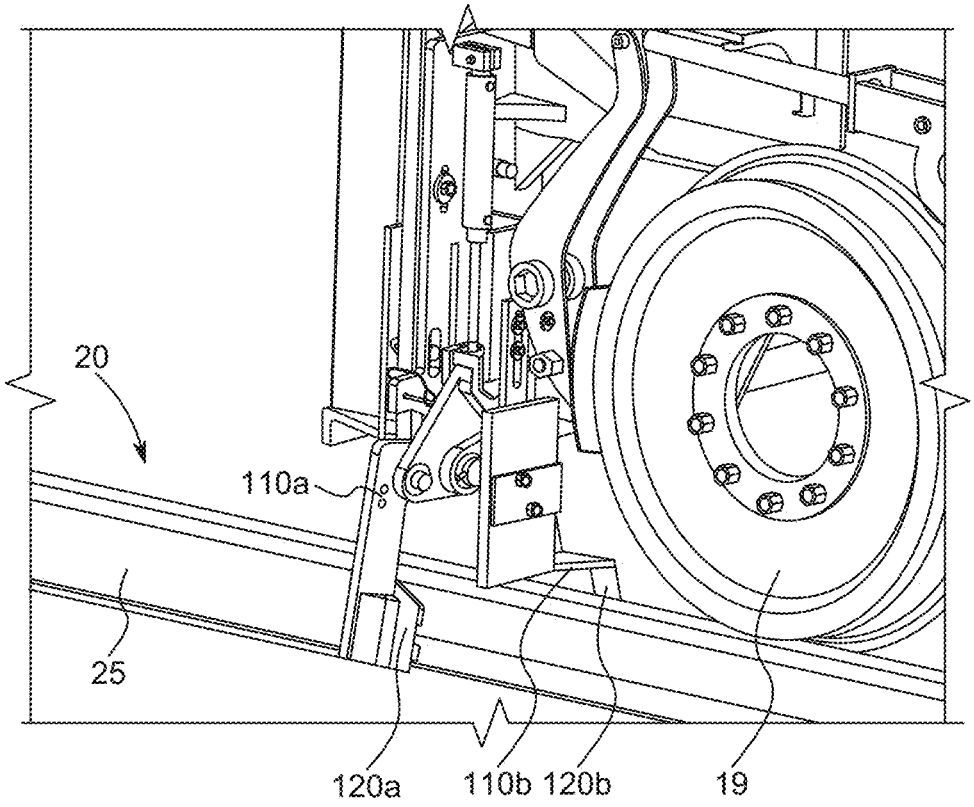

FIGS. 2A-2B, collectively referred to herein as FIG. 2, are illustrations of an MSR 100 by which the concept described in the present disclosure may be embodied. MSR 100 is depicted in FIG. 2 as it might be installed around the wheels, representatively illustrated at wheel 19, of a sand plow 10. It is to be understood that MSR 100 may be deployed elsewhere on sand plow 10, although the wheel location may serve as a convenient pneumatic tap-in point. FIG. 2A depicts MSR 100 in its retracted state, in which MSR 100 is disengaged from track 20, and FIG. 2B depicts MSR 100 in its engaged state in which rail web wiper pads 120*a*-120*b* thereof engage track 20 at its rail web 25, which is formed between rail head 22 and rail foot 28. In FIG. 2, it is to be assumed that sand plow 10, to which MSR 100 is attached in this example, is moving from right to left on the drawing page. Under that assumption, it is to be noted that rail web wiper pads 120*a* and 120*b* may be mechanically coupled to respective caliper arms 110*a*-110*b* at an acute angle θ (see FIG. 3). Such arrangement compels rail web wiper pads 120*a* and 120*b* against the rail web 25 at an oblique angle Ω supplementary to angle θ to work in a manner similar to chisels or wood planes to lift the sand away from rail web 25 as the sand plow 10 moves in the aforementioned direction.

Certain embodiments of the concept described in the present disclosure may include a rail head wiper 130 to remove sand from rail head 22 of rail 20. In the illustrated example, the rail head wiper 130 is installed relative to MSR 100 such that the rail head wiping operation succeeds the rail web wiping operation, although such arrangement is not necessary to practice the concept described in the present disclosure. Additionally, rail head wiper 130 may be made selectively deployable to engage and disengage rail head 22 in concert with the engagement and disengagement of rail web wiper pads 120*a* and 120*b* with rail web 25.

Figure 3A:
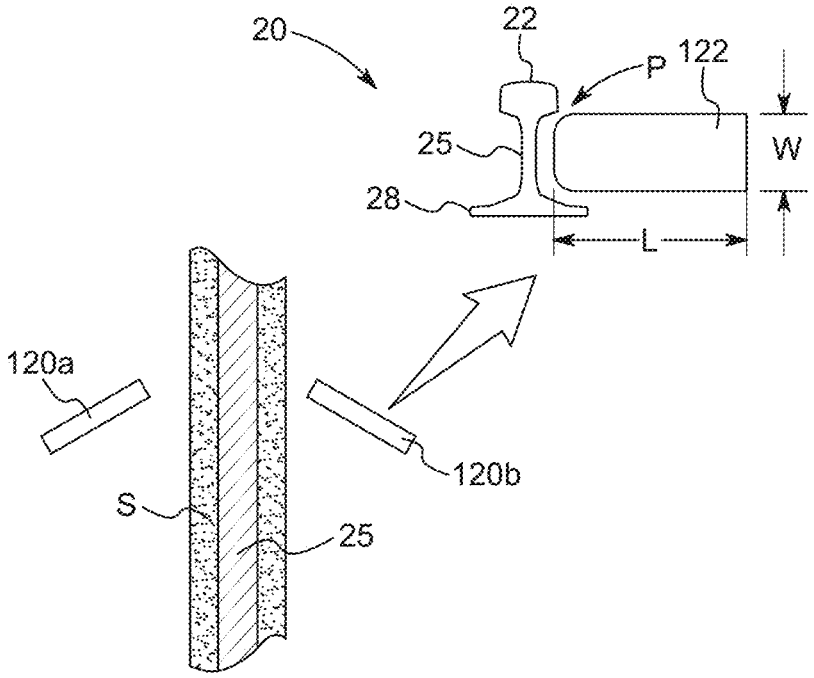
FIGS. 3A-3B are illustrations of a sand removal technique by which the concept described in this disclosure may be embodied.
Figure 3B:
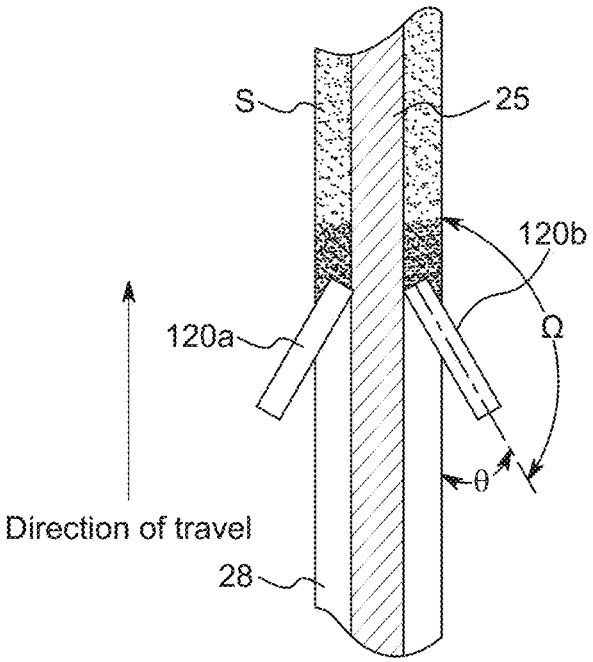
Figure 4A:
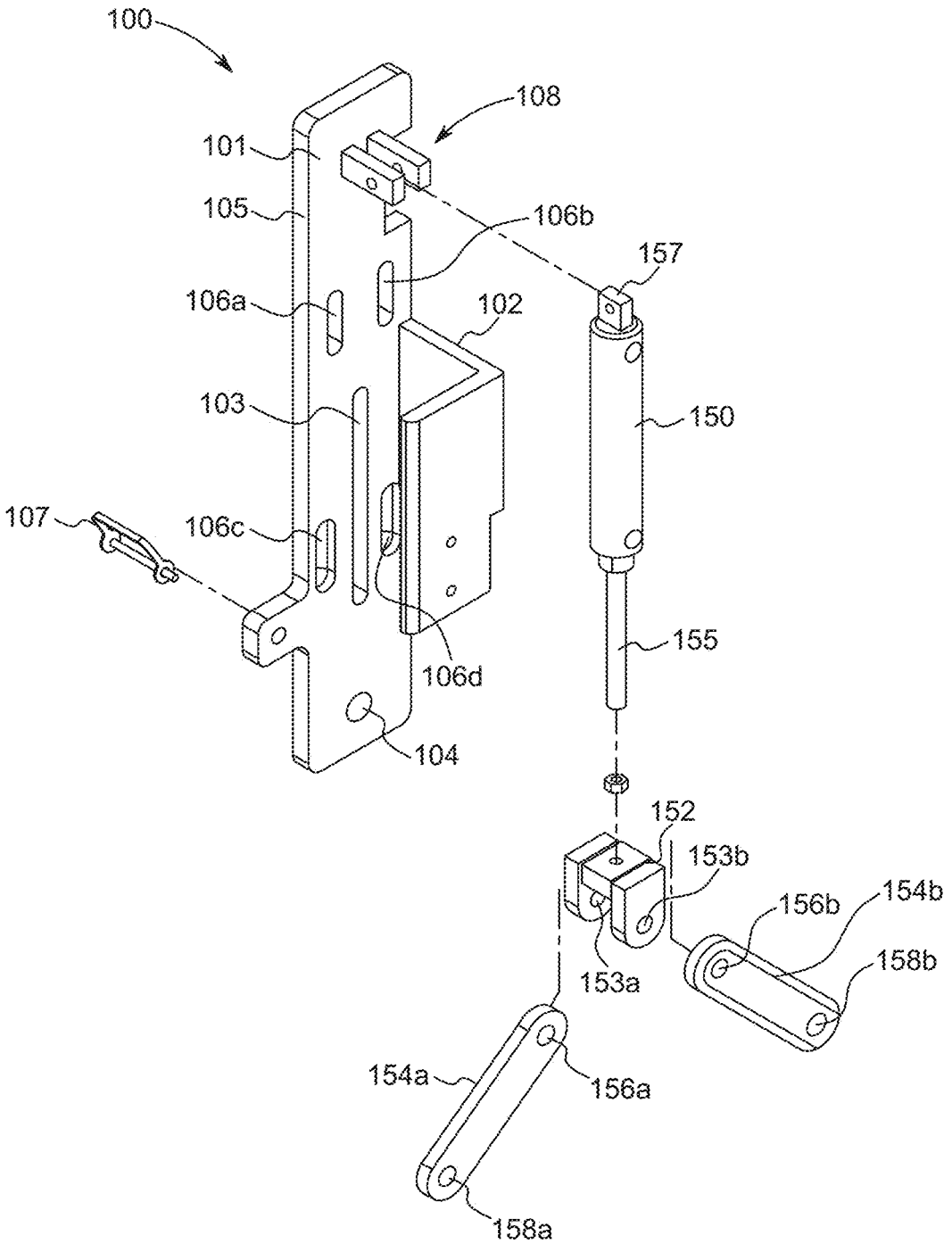
FIGS. 4A-4E are exploded view illustrations of a mechanical sand remover by which the concept described in this disclosure may be embodied.
Figure 4B:
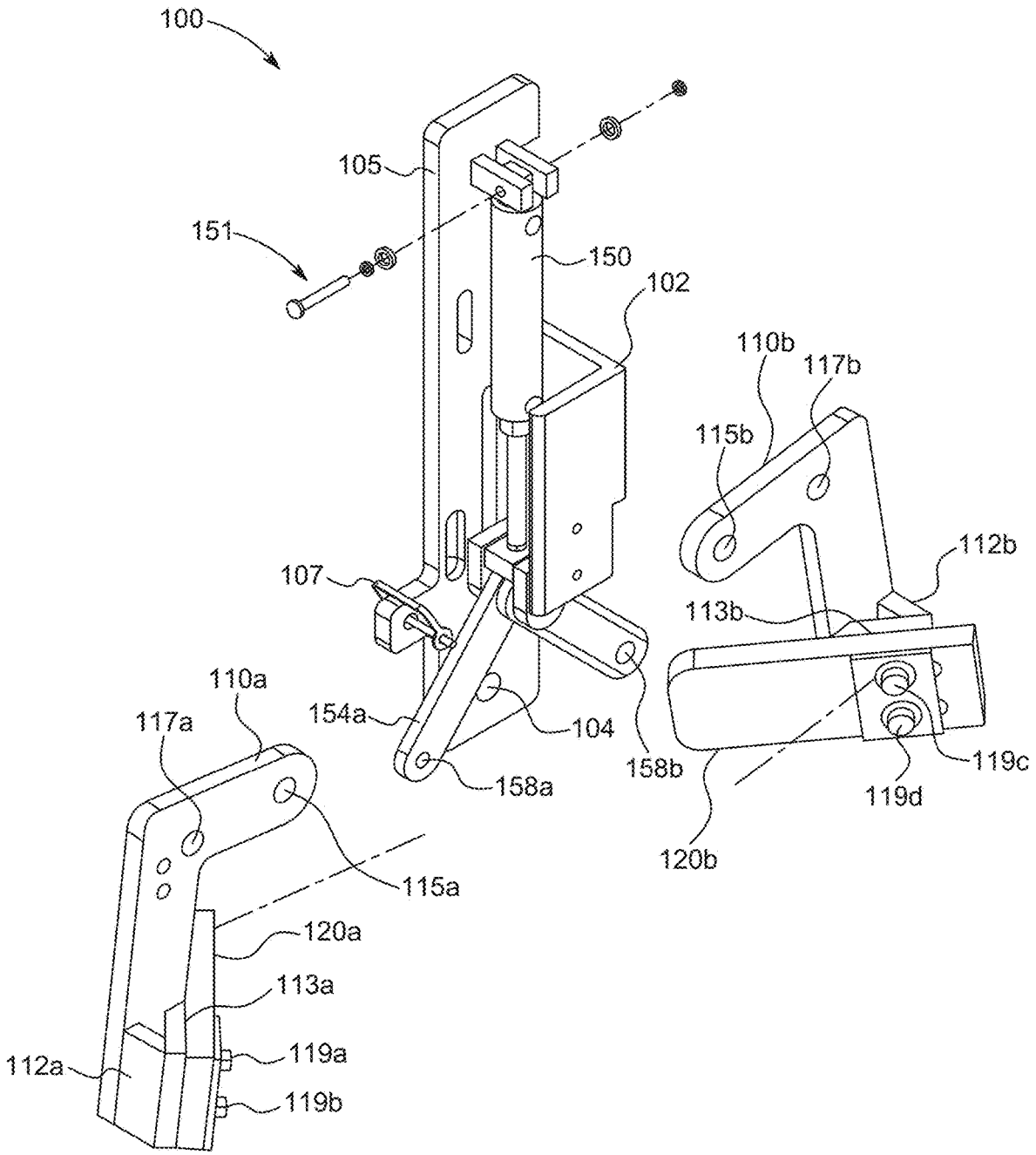
Figure 4C:
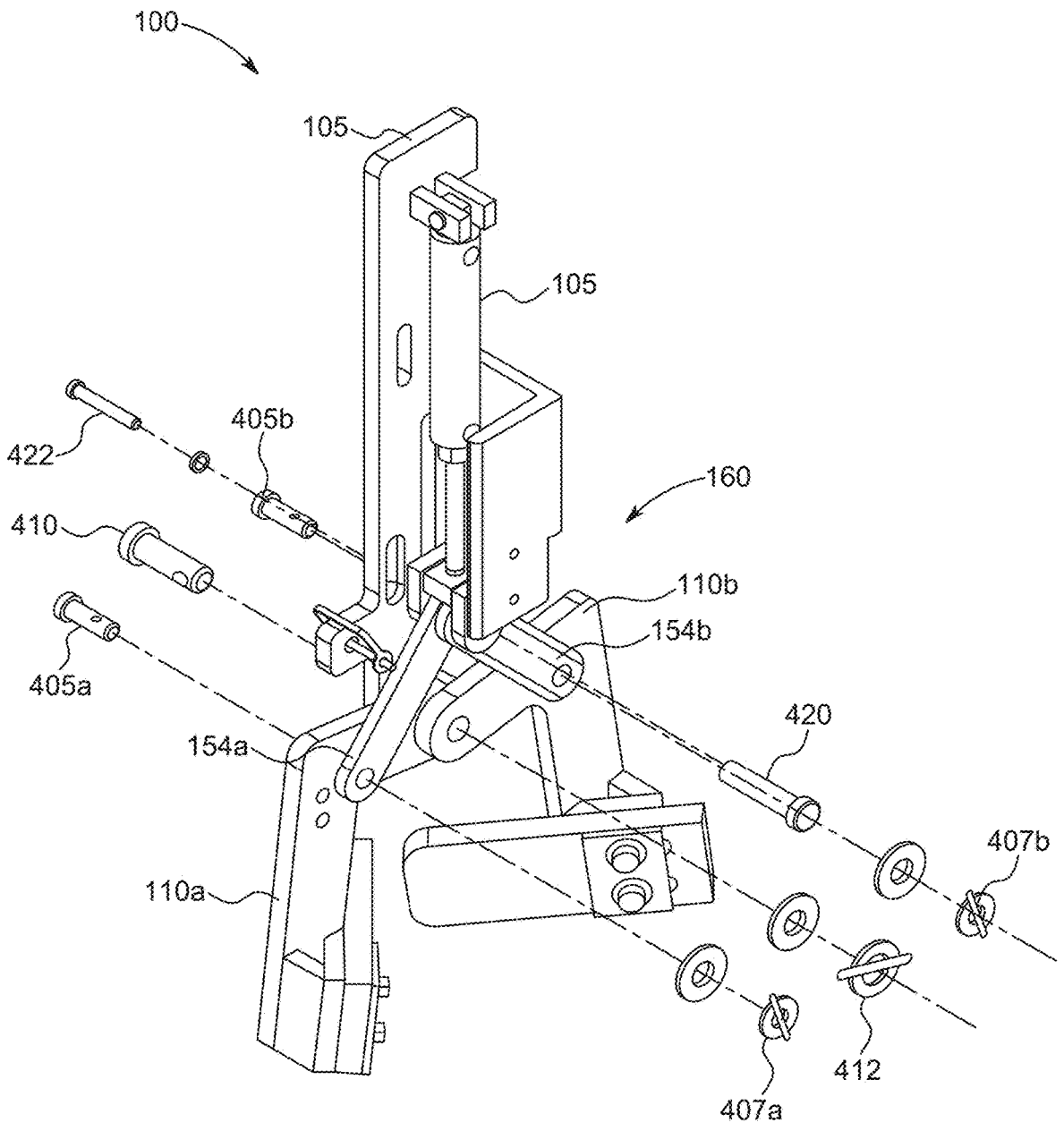
Figure 4D:
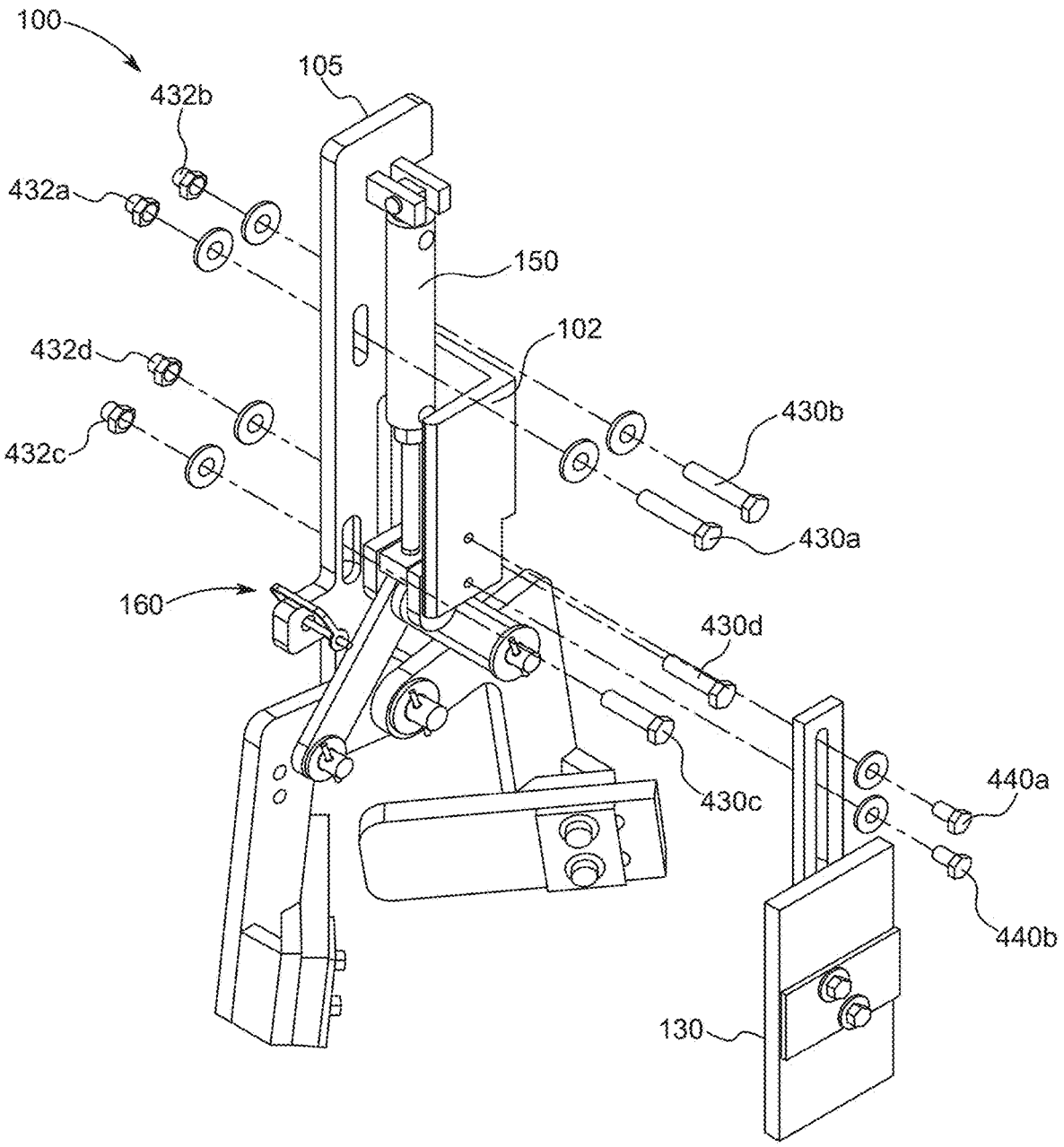
Figure 4E:
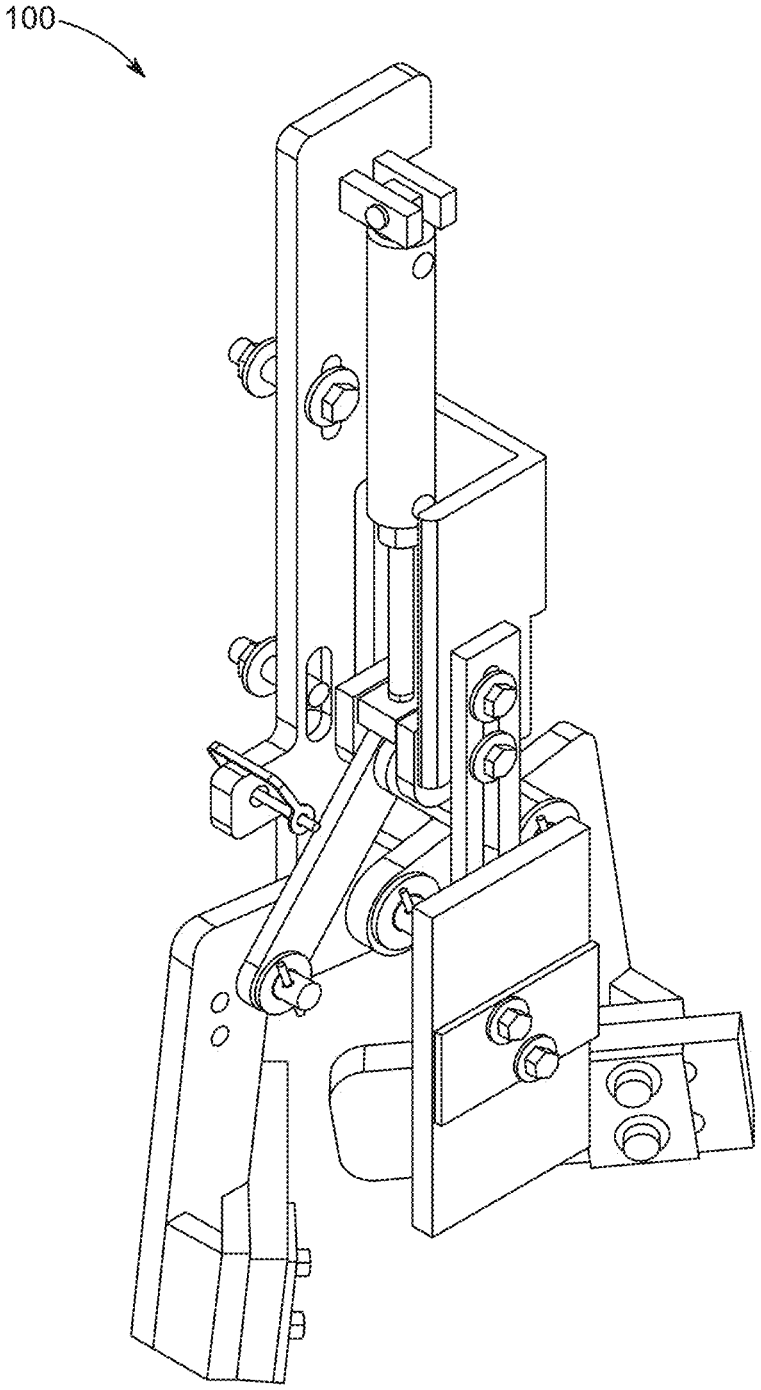

FIGS. 3A-3B, collectively referred to herein as FIG. 3, are illustrations of a sand removal technique by which the concept described in the present disclosure may be embodied. FIG. 3A depicts rail web wiper pads 120*a* and 120*b* in their retracted state and FIG. 3B depicts rail web wiper pads 120*a* and 120*b* in their engaged state. The transition between retracted and engaged states may be made by operator command, as explained with respect to FIG. 5. Rail web wiper pads 120*a* and 120*b* may engage respective sides of rail web 25 at forty (40) or more psi of pressure, but such can be varied by embodiment.

As illustrated in FIG. 3, rail web wiper pads 120*a* and 120*b*, as well as rail head wiper 130, may each be constructed from a plate 122 of a thermoplastic polymer such polypropylene. Plate 122 may have a lateral dimension W that is approximately the transverse dimension of rail web 25, and a longitudinal dimension L that is sized to achieve a certain stiffness/flexibility in rail web wiper pads 120*a* and 120*b* from a mounting point within that dimension L. One end of plate 122 may be shaped to have a profile P that is complementary to the rail web shape as defined by rail head 22 and rail foot 28.

In the engaged state illustrated in FIG. 3B, rail web wiper pads 120*a* and 120*b* may engage opposite sides of rail web 25 to remove sand S left therein from forward plow blade 12. With rail web wiper pads 120*a* and 120*b* mounted to caliper arms 110*a* and 110*b* at an angle θ, rail web wiper blades 120*a* and 120*b* engage rail web 25 at an oblique angle Ω that is supplementary to acute angle θ to force sand S away from rail 20 in a manner similar to a chisel or wood plane. Thus, the apex of angle θ is directed towards the direction of travel.

FIGS. 4A-4E, collectively referred to herein as FIG. 4, are exploded view illustrations of an MSR 100 by which the concept described in the present disclosure may be embodied. MSR 100 may include a mounting bracket 105 by which the remaining assembly components are mechanically coupled to sand plow 10. To that end, mounting bracket 105 may have a rail head wiper mount 102 and a set 108 of prongs extending from and rigidly attached to mounting bracket face 101. Mounting bracket 105 may have formed therein a slider slot 103 that constrains the travel of a sliding pin 420 during actuation of MSR 100, a pivot bore 104 through which a pivot pin 410 is received about which components of mechanical sand remover 100 rotate and bracket mounting slots 106*a*-106*d* through which mounting bolts 430*a*-430*d* extend that, in combination with respective mounting nuts 432*a*-432*d*, secures mounting bracket 105 to sand plow 10. Mounting bracket 105 may also include a spring mounting tab 109 to which a spring 107 may be mechanically coupled.

As illustrated in FIG. 4, a proximal end of a pneumatic actuator 150 may have an actuator mounting tab 157 that may be received into prongs 108 and retained in place by an actuator mounting bolt 151. The distal end of actuator 150 may be rigidly affixed to a clevis 152, such as through a threaded engagement that allows for adjustment of the position of clevis 152 relative to slider slot 103. Clevis 152 may be further coupled to an engagement mechanism 160 that converts the linear force provided by pneumatic actuator 150 into rotary force on caliper arms 110*a* and 110*b*. This may be achieved through an arrangement of linear links 154*a* and 154*b* such that linear motion of clevis 152, as compelled by relatively lengthening pneumatic actuator 150, results in rotary motion of caliper arms 110*a* and 110*b* towards rail web 25. Conversely, linear motion of clevis 152 as compelled by relatively shortening pneumatic actuator 150 may result in rotary motion of caliper arms 110*a* and 110*b* away from rail web 25.

As illustrated in FIG. 4, caliper arms 110*a* and 110*b* may have angle brackets 112*a* and 112*b*, respectively, on which web wiper pads 120*a* and 120*b* are securely mounted through web wiper mounting screws 119*a*-119*b* and 119*c*-119*d*, respectively. Angle brackets 112*a* and 112*b* may have respective angle bracket faces 113*a* and 113*b* that define the angles θ and Ω discussed above. Additionally, caliper arms 110*a* and 110*b* may have formed therein respective pivot bores 115*a* and 115*b*, and respective linkage bores 117*a* and 117*b*.

Engagement mechanism 160 may include a pivot pin 420 that extends through pivot bore 104 on mounting bracket 105 and through pivot bores 117*a* and 117*b* on respective caliper arms 110*a* and 110*b* and may be held in place by a retaining pin 412. Further, engagement mechanism 160 may include a sliding pin 420 that extends through clevis bore 153*b*, proximal linkage bores 156*a* and 156*b* in respective linkages 154*a* and 154*b*, clevis bore 153*a* and slider slot 103 and may be held in place by a retaining fastener 422. Additionally, engagement mechanism 160 may include caliper arm pins 405*a* and 405*b* that extend through respective linkage bores 117*a* and 117*b* and respective distal linkage bores 158*a* and 158*b* and may be held in place by respective retaining pins 407*a* and 407*b*. In certain embodiments, retaining pins 407*a*, 407*b* and 412 may be readily removed and caliper arms 110*a* and 110*b* can be removed thereby, such as for replacement of web wiper pads 120*a* and 120*b* and other maintenance tasks.

In certain embodiments, caliper arms 110*a* and 110*b* may be elastically preloaded into the retraction state, such as by a spring 107. Thus, removal of pressure from pneumatic actuator 105 may result in placing MSR 100 in its retraction state, but by the elastic force of spring 107 as opposed to pneumatically induced force. However, certain embodiments may deploy actuators that are pneumatically controlled in both directions.

As illustrated in FIG. 4, rail head wiper 130 may be attached to MSR 100 on rail head wiper mount 102 at a position relative to mounting bracket 105 that positions rail head wiper 130 on a rail for which the embodiment is designed. Additionally, in some embodiments, rail head wiper 103 may be mechanically coupled to clevis 152, albeit perhaps indirectly, to engage and disengage with rail head 22 in concert with the engagement and disengagement of rail web wiper pads 120*a* and 120*b* on rail web 25.

Figure 5:
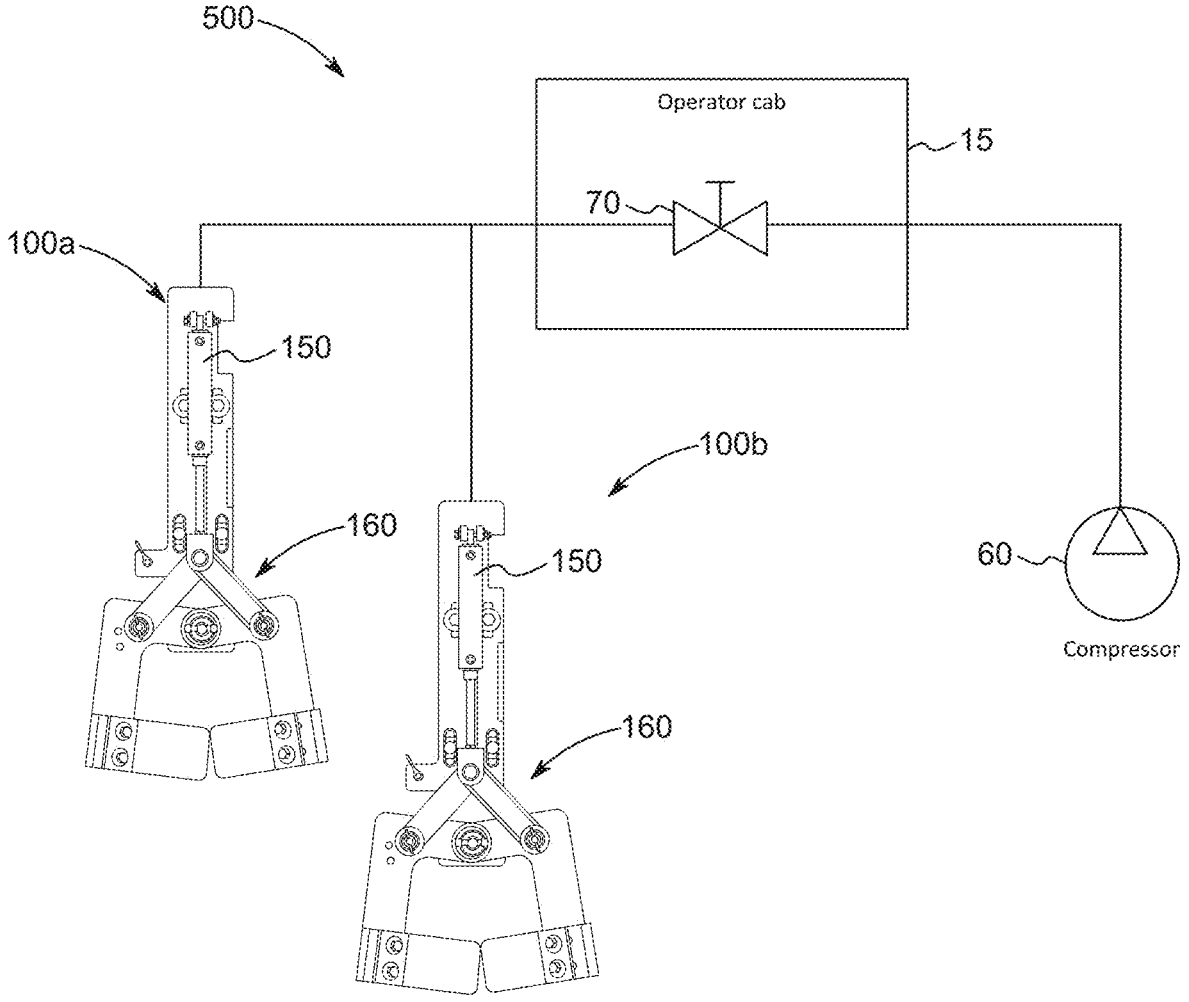
FIG. 5 is a pneumatic flow diagram of a mechanical sand removal system by which the concept described in this disclosure may be embodied.

FIG. 5 is a pneumatic flow diagram of a mechanical sand removal system 500 by which the concept described in the present disclosure may be embodied. The figure is not intended to be a detailed pneumatic system diagram but rather a simple schematic diagram sufficient to explain the subject embodiment to one skilled in pneumatic systems.

Pneumatic pressure to operate MSRs 100*a* and 100*b*, i.e., one for each rail of a railroad track, may be derived from a compressor 60, which may be a system compressor that may be regulated downwards as necessary to operate mechanical sand removal system 500. A pneumatic line may connect compressor 60 to a pneumatic valve 70 located in operator cabin 15. Pneumatic valve 70 may be connected to MSRs 100*a* and 100*b* through one or more pneumatic lines with pneumatic pressure therein dictated by the state of pneumatic valve 70. Application of pressure through pneumatic valve 70 is applied to actuators 150 and the force is transferred to engagement mechanisms 160 to rotate the rail web wiper pads towards the rail web 25. Removal of pressure through pneumatic valve 70 retracts actuators 150 and engagement mechanisms 160 rotate the rail web wiper pads 120*a* and 120*b* away from the rail web 25. In certain embodiments, the retracted state is made default by an elastic force, such as by spring 107.

INDUSTRIAL APPLICABILITY

Much of industry occurs on railroad tracks and some of that industry is established in regions of the Globe at which shifting sand is commonplace. Mining is such an industry where mined material is moved by rail and, in Middle Eastern countries where such mining takes place, blowing sand can completely cover the railroad tracks on which that material movement relies. Sand plows have been developed that remove a vast majority of the offending sand but may leave sand that has built up in the rail web. The concept described herein completes a railroad track clearing technique that removes sand that has built up in the rail web.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the concept described in the present disclosure (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

The descriptions above are intended to illustrate possible implementations of concept described in the present disclosure and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the concept described in this disclosure should therefore be determined not with reference to the description above, but with reference to the appended claims, along with their full range of equivalents.

The invention claimed is:

1. A mechanical sand remover that removes sand from a railroad rail, the mechanical sand remover comprising:

an actuator;

a pair of web wiper pads having a lateral dimension that corresponds to a lateral dimension of a rail web of the railroad rail; and a caliper mechanism mechanically coupled to the actuator and operable thereby into a retraction state and an engagement state, the caliper mechanism including a pair of caliper arms respectively coupled to the web wiper pads at an angle relative thereto.

2. The mechanical sand remover of claim 1, further comprising an angle bracket mechanically interposed between each of the caliper arms and the corresponding web wiper pad attached thereto, the angle bracket defining the angle at which the web wiper pads are coupled to the respective caliper arms.

3. The mechanical sand remover of claim 1, further comprising an engagement mechanism mechanically interposed between the actuator and the caliper mechanism and constructed to convert linear force of the actuator into rotational force on the caliper arms of the caliper mechanism.

4. The mechanical sand remover of claim 3, wherein the engagement mechanism comprises a set of linear links that perform the conversion from the linear force into the rotational force.

5. The mechanical sand remover of claim 4, further comprising a clevis mechanically interposed between the actuator and the linear links.

6. The mechanical sand remover of claim 1, wherein the web wiper pads are constructed from a thermoplastic polymer.

7. The mechanical sand remover of claim 6, wherein the thermoplastic polymer is polypropylene.

8. The mechanical sand remover of claim 1, further comprising a rail head wiper that removes sand from the rail head of the railroad rail.

9. A mechanical sand remover system that removes sand from a railroad track comprising a pair of rails, the mechanical sand remover system comprising:

a pneumatic compressor;

a pair of mechanical sand removers that removes sand from the rails, each of the mechanical sand removers comprising:

an actuator in pneumatic communication with the pneumatic compressor;

a pair of web wiper pads having a lateral dimension that corresponds to a lateral dimension of a rail web of the railroad rail; and a caliper mechanism mechanically coupled to the actuator and operable thereby into a retraction state and an engagement state, the caliper mechanism including a pair of caliper arms respectively coupled to the web wiper pads at an angle relative thereto; and a pneumatic control that selectively provides pneumatic pressure to the actuator to compel the retraction state and the engagement state of the caliper mechanism.

10. The mechanical sand remover system of claim 9, further comprising an angle bracket mechanically interposed between each of the caliper arms and the corresponding web wiper pad attached thereto, the angle bracket defining the angle at which the web wiper pads are coupled to the respective caliper arms.

11. The mechanical sand remover system of claim 9, further comprising an engagement mechanism mechanically interposed between the actuator and the caliper mechanism and constructed to convert linear force of the actuator into rotational force on the caliper arms of the caliper mechanism.

12. The mechanical sand remover system of claim 11, wherein the engagement mechanism comprises a set of linear links that perform the conversion from the linear force into the rotational force.

13. The mechanical sand remover system of claim 12, further comprising a clevis mechanically interposed between the actuator and the linear links.

14. The mechanical sand remover system of claim 9, wherein the web wiper pads are constructed from a thermoplastic polymer.

15. The mechanical sand remover system of claim 14, wherein the thermoplastic polymer is polypropylene.

16. The mechanical sand remover system of claim 9, further comprising a rail head wiper that removes sand from the rail head of the railroad rail.

17. A sand plow that removes sand from a railroad track, the sand plow comprising:

a forward plow blade having a pair of rail voids that accommodate a pair of rails of the railroad track; and a pair of mechanical sand removers that remove sand from the rails left by the rail voids in the forward plow blade, each of the mechanical sand removers comprising:

an actuator;

a pair of web wiper pads having a lateral dimension that corresponds to a lateral dimension of a rail web of the corresponding one of the rails; and a caliper mechanism mechanically coupled to the actuator and operable thereby into a retraction state and an engagement state, the caliper mechanism including a pair of caliper arms respectively coupled to the web wiper pads at an angle relative thereto.

18. The sand plow of claim 17, wherein each of the mechanical sand removers further comprises an angle bracket mechanically interposed between each of the caliper arms and the corresponding web wiper pad attached thereto, the angle bracket defining the angle at which the web wiper pads are coupled to the respective caliper arms.

19. The sand plow of claim 17, wherein each of the mechanical sand removers further comprises an engagement mechanism mechanically interposed between the actuator and the caliper mechanism and constructed to convert linear force of the actuator into rotational force on the caliper arms of the caliper mechanism.

20. The sand plow of claim 17, wherein each of the mechanical sand removers further comprises a rail head wiper that removes sand from the rail head of the railroad rail.

* * * * *